US008588595B2

(12) United States Patent
Benichou

(10) Patent No.: US 8,588,595 B2
(45) Date of Patent: Nov. 19, 2013

(54) TOWEL DRIER RADIATOR WITH HEAT CARRIER FLUID INCLUDING AN ADDITIONAL HEATING DEVICE

(75) Inventor: Fabrice Benichou, Estrablin (FR)

(73) Assignee: Imhotep Creation, Montplaisir (FR)

( * ) Notice: Subject to any disclaimer, the term of this patent is extended or adjusted under 35 U.S.C. 154(b) by 923 days.

(21) Appl. No.: 12/677,713

(22) PCT Filed: Oct. 14, 2008

(86) PCT No.: PCT/FR2008/001437
§ 371 (c)(1),
(2), (4) Date: Mar. 11, 2010

(87) PCT Pub. No.: WO2009/087298
PCT Pub. Date: Jul. 16, 2009

(65) Prior Publication Data
US 2010/0209086 A1 Aug. 19, 2010

(30) Foreign Application Priority Data
Nov. 20, 2007 (FR) ..... 07 08128

(51) Int. Cl.
*F28D 7/00* (2006.01)
*F24D 19/02* (2006.01)

(52) U.S. Cl.
USPC ..... 392/496; 392/360; 392/370

(58) Field of Classification Search
None
See application file for complete search history.

(56) References Cited

U.S. PATENT DOCUMENTS

| | | | | | |
|---|---|---|---|---|---|
| 2,494,861 | A * | 1/1950 | Chapman | 219/524 |
| 3,626,602 | A * | 12/1971 | Glowacki | 4/622 |
| 4,094,076 | A * | 6/1978 | Baslow | 34/90 |
| 4,625,432 | A * | 12/1986 | Baltes | 34/621 |
| 5,394,619 | A * | 3/1995 | Kaplan | 34/90 |
| 5,548,100 | A * | 8/1996 | Miller | 219/521 |
| 5,642,462 | A * | 6/1997 | Huff | 392/382 |
| RE35,834 | E * | 7/1998 | Miller | 219/521 |
| 5,829,161 | A * | 11/1998 | Hung et al. | 34/202 |
| 6,080,974 | A * | 6/2000 | Ambrosiano | 219/544 |
| 6,153,862 | A * | 11/2000 | Job | 219/521 |
| 6,327,792 | B1 * | 12/2001 | Hebert | 34/104 |
| 6,363,627 | B1 * | 4/2002 | Lai | 34/621 |
| 6,842,581 | B2 * | 1/2005 | Schafer | 392/380 |
| 6,928,752 | B2 * | 8/2005 | Johnson et al. | 34/595 |
| 6,935,279 | B2 * | 8/2005 | Bosworth | 122/4 R |
| D552,808 | S * | 10/2007 | Garman et al. | D32/8 |
| D615,715 | S * | 5/2010 | Zielinski | D32/8 |
| 8,122,613 | B2 * | 2/2012 | Sanders | 34/565 |
| 8,322,541 | B2 * | 12/2012 | Maclaren-Taylor | 211/16 |
| 2004/0022529 | A1 * | 2/2004 | Lamb | 392/465 |

(Continued)

FOREIGN PATENT DOCUMENTS

| | | | |
|---|---|---|---|
| DE | 20114576 | * | 12/2001 |
| FR | 2684749 | A1 * | 6/1993 |

(Continued)

*Primary Examiner* — Thor Campbell
(74) *Attorney, Agent, or Firm* — Oliff & Berridge, PLC

(57) ABSTRACT

The object of the invention is a towel drying radiator comprising two vertical uprights between which heating bars are fitted. Said radiator is equipped with an additional device for heating an air flow. Said device comprises a telescopic rail supporting a heating apparatus heating the air flow, said telescopic rail being provided with fixing means to the two vertical uprights of said radiator, said fixing means forming means for blanking off two apertures arranged through a respective wall of said vertical uprights.

10 Claims, 12 Drawing Sheets

(56) References Cited

U.S. PATENT DOCUMENTS

| | | | | |
|---|---|---|---|---|
| 2008/0138054 | A1* | 6/2008 | Short | 392/485 |
| 2010/0199513 | A1* | 8/2010 | Sanders | 34/82 |
| 2012/0018461 | A1* | 1/2012 | Azizian et al. | 223/66 |

FOREIGN PATENT DOCUMENTS

| | | | |
|---|---|---|---|
| FR | 2842887 | * | 1/2004 |
| FR | 2 897 675 | | 8/2007 |
| WO | WO 9628696 | * | 9/1996 |

* cited by examiner 2
4
3
11
21
20
15
14
13

4
3
2
13
16
14

4
19
18

52
53
54
54'
55
56
57

TOWEL DRIER RADIATOR WITH HEAT CARRIER FLUID INCLUDING AN ADDITIONAL HEATING DEVICE

BACKGROUND OF THE INVENTION

The present invention is in the field of heating systems on residential premises or the like. The object of the invention is to provide a towel drying radiator with a heat transfer fluid equipped with an additional heating device.

STATE OF THE ART

Towel drying radiators are known designed to be installed in a room in a home or the like, such as a bathroom, or in changing rooms for example, to heat the air contained inside said room and at the same time to dry a towel or suchlike placed on the radiator. For this purpose, such a radiator is for example arranged in the form of a ladder and comprises two vertical uprights between which horizontal heating bars are arranged. The vertical uprights and horizontal heating bars extend in a general extension plane of the radiator which is normally designed to be arranged parallel to a support surface of the radiator such as a wall of the room or the like.

The document FR 2897575 describes one such towel drying radiator that is equipped with an additional device for heating the air contained inside the room. The additional device is a heating device by natural convection or by radiation of said air. The additional device is integral to one of the vertical uprights being, according to various alternative embodiments, either arranged laterally to this vertical upright and in the general extension plane of the radiator or fitted between said plane and the support surface on which the radiator is fixed.

A general problem arising from use of such a radiator lies in the fact that they are not well suited to a small room, such as a bathroom of small dimensions, due to the general surface occupation they engender.

OBJECT OF THE INVENTION

The object of the present invention is to propose a towel drying radiator that presents overall dimensions that are as small as possible so as to be easily installed inside a domestic room of small dimensions, the towel drying radiator nevertheless being efficient, robust and easy to assemble.

The towel drying radiator of the present invention is a towel drying radiator with a heat transfer fluid comprising two vertical uprights between which horizontal heating bars are arranged. Said radiator is equipped with an additional heating device for heating an air flow.

According to the present invention, said device comprises a telescopic rail supporting a heating apparatus of the air flow, said telescopic rail being provided with fixing means to the two vertical uprights of said radiator, said fixing means constituting means for blanking off two apertures arranged through a respective wall of said vertical uprights.

These arrangements are such that the heating apparatus is housed inside a space situated between the two vertical uprights to limit the global space occupation engendered by the radiator as far as possible, in particular on each side of the vertical uprights. These arrangements enable such a radiator to be installed in a room of small dimensions, such as for example a bathroom with a surface area of a few square meters.

A further result of these arrangements is an ease of fitting the additional heating device on a towel drying radiator of relatively any dimensions, and in particular with a width corresponding to relatively any distance between the two vertical uprights, by means of simple adjustment of the length of the telescopic rail.

This finally results in an optimized adaptability of such an additional heating device which is able to be fitted on a wide range of towel drying radiators, the respective width of which is liable to be different from one radiator to the other.

This finally results in an ease and rapidity of installation of said device on the radiator and in a reduction of storage and referencing costs of said device or of the elements composing the latter, due to the fact that it can be fitted on relatively any radiator.

Said device is advantageously at least partially located inside the general extension plane of the device comprising the vertical uprights and the heating bars.

These arrangements have the object of minimizing the overall space occupation engendered by said device even further, in particular on each side of said plane. More precisely, such a radiator presents a thickness, measured perpendicularly to the general extension plane, that is as small as possible.

The device preferably comprises a case provided with at least one air inlet, arranged through a first partition of the case, which is designed to be directed towards a support surface of said radiator, and with at least one air outlet, arranged through a second partition of the case, which is placed facing the first partition.

The case is preferably equipped with at least one decorative panel containing decorative patterns.

The case advantageously houses a pulser and at least one heating element, and supports a control panel for implementing operation of the pulser and the heating element.

The case and the telescopic rail are preferably equipped with complementary securing means operating in conjunction with one another when assembly is performed.

Said securing means are in particular of the clipping type or such like.

Said securing means preferably comprise on the one hand a first nut for fixing a first lug equipping the telescopic rail onto a first vertical upright, and on the other hand a second nut for fixing a second lug equipping the telescopic rail onto a second vertical upright, the second fixing nut being integral to an electrical resistance housed inside the second vertical upright, the first and second nuts being equipped with a respective O-ring.

The air inlet is preferably equipped with a removable particle filter.

The air outlet is in particular equipped with at least one fin for directing a hot air flow.

DESCRIPTION OF THE DRAWINGS

The present invention will be better understood and details relating thereto will become clearly apparent from reading the description that will now be given of a preferred embodiment in relation to the figures of the accompanying drawings, in which:

FIGS. 12*a* to 13*b* illustrate the connection system of the pulser to the towel drying radiator.

DETAILED DESCRIPTION OF AN EMBODIMENT

Figure 1:
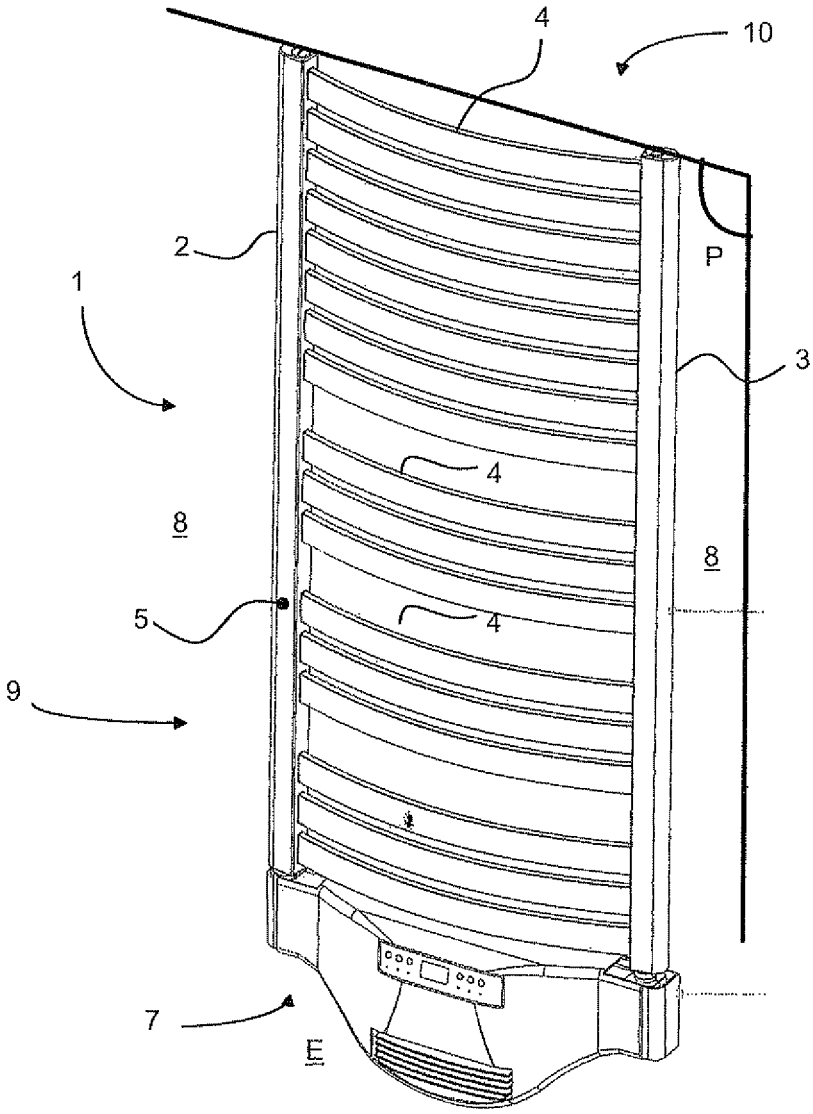
FIG. 1 is a schematic illustration in perspective view of a towel drying radiator according to the present invention.

In FIG. 1, a towel drying radiator 1 is designed to equip a room in a home, changing rooms or the like, in particular of small dimensions, such as a ground surface of a few square meters, to heat the air contained inside said room and at the same time to heat a towel or the like placed on towel drying radiator 1. Radiator 1 is of the type arranged as a ladder and comprises two vertical uprights 2,3 between which horizontal heating bars 4 are arranged. Towel drying radiator 1 is in particular of the type with a heat transfer fluid comprising a circulation circuit 5 of said fluid arranged inside vertical uprights 2,3 and horizontal heating bars 4. Vertical uprights 2,3 form respective heat transfer fluid collectors.

Figure 14:
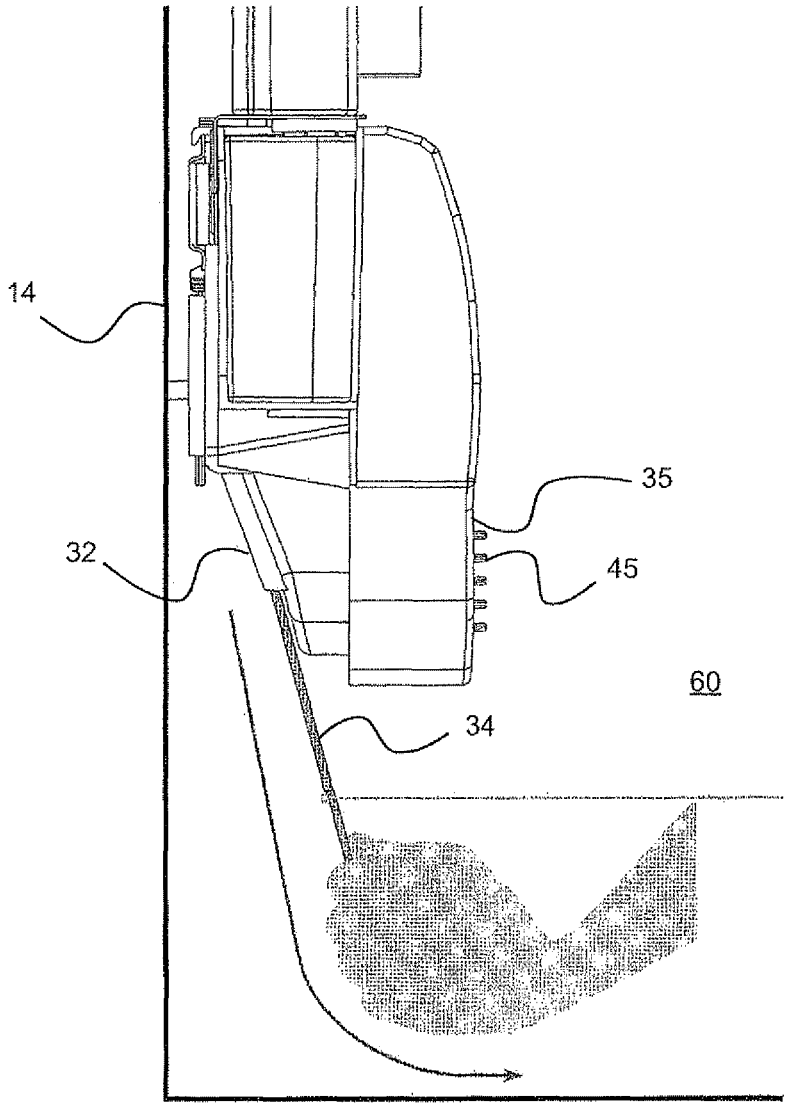
FIG. 14 represents removal of the filter via the front.

Vertical uprights 2,3 and horizontal heating bars 4 are arranged inside a general extension plane P of towel drying radiator 1 which is designed to be placed parallel to a support surface 6 for attaching said radiator, which can be seen in FIG. 14, situated in the background of general extension plane P of towel drying radiator 1.

Towel drying radiator 1 is provided with an additional device 7 for heating the ambient air contained inside the room. Such a device 7 is in particular of the convection type. These arrangements are such that when a towel is hung on one of horizontal heating bars 4 of radiator 1, the air contained in the room is efficiently heated by additional device 7 without being disturbed by the fact that the towel at least partially covers horizontal heating bars 4.

To reduce the global space occupation engendered by such a towel drying radiator 1 as far as possible, it is advantageously proposed by the present invention to fit said device 7 jointly on the two vertical uprights 2,3 in such a way that device 7 is on the one hand at least partially arranged inside general extension plane P of the towel drying radiator and on the other hand housed in a space E inscribed in the continuation of the two vertical uprights 2,3. It results from these arrangements that the lateral volumes 8 situated on each side of vertical uprights 2,3 are in no way encumbered by said device 7. It also results that a front volume 9 and rear volume 10 situated on each side of general extension plane P of a towel drying radiator 1 are also in no way encumbered by said device 7. It finally results in such a towel drying radiator 1 being particularly suitable for installation in a room of small dimensions.

Figure 2:
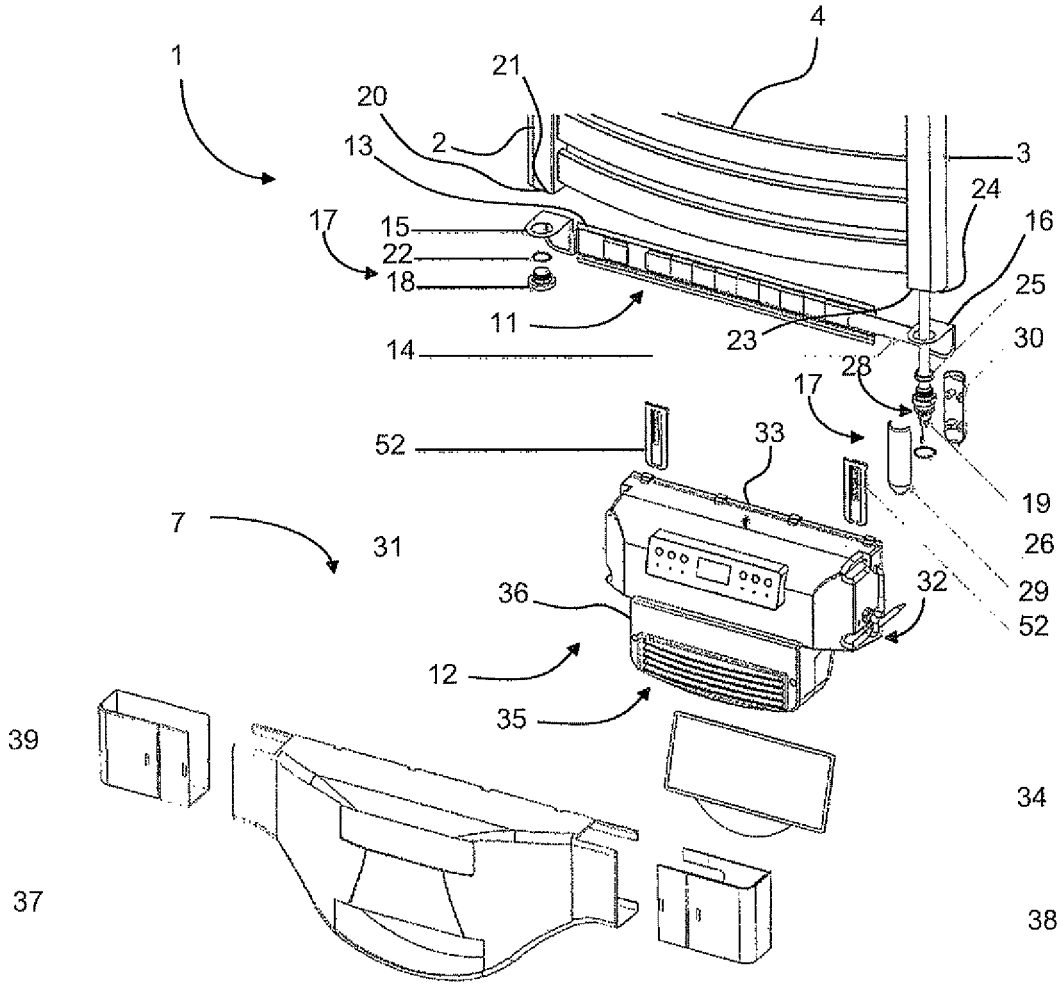
FIG. 2 is a partial schematic illustration in exploded perspective view of the radiator represented in the previous figure.
Figure 5:
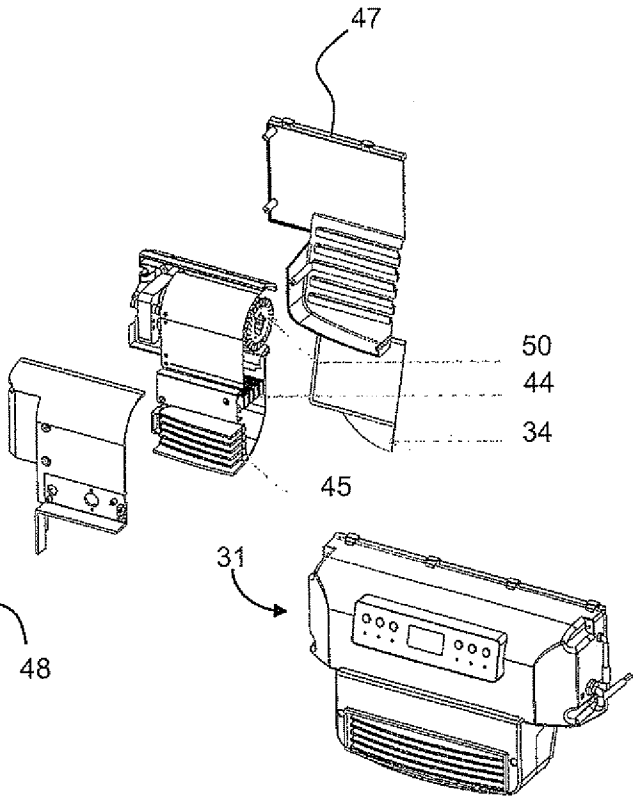
FIG. 5 is a schematic illustration of the case illustrated in FIGS. 3 and 4 in perspective view.

In FIG. 2, said device 7 comprises a telescopic rail 11 supporting a heating apparatus 12 heating an air flow. Telescopic rail 11 comprises a fixed rail 13 inside which a movable rail 14 is able to slide so that telescopic rail 11 is able to be adjusted to a towel drying radiator 1 presenting a distance L between the two vertical uprights 2,3 which can be relatively any distance. This results in such a device 7 being adaptable to a wide range of towel drying radiators 1.

Fixed rail 13 is provided with a first fixing lug 15 for securing to a first vertical upright 2 of towel drying radiator 1 whereas movable rail 14 is provided with a second fixing lug 16 for securing to a second vertical upright 3 of towel drying radiator 1. Telescopic rail 11 is suspended from the towel drying radiator by fixing means 17 comprising a first nut 18 and a second nut 19.

More particularly, first fixing lug 15 is secured on first vertical upright 2 by means of first nut 18 which is designed to be arranged inside a first aperture 20 arranged through a first wall 21 of first vertical upright 2. Said first wall 21 is preferably a bottom wall of said first vertical upright 2 in order to limit the general space occupation engendered by towel drying radiator 1 even further. A first O-ring of elliptical cross-section 22 is fitted between first fixing lug 15 and first nut 18 to prevent the heat transfer fluid from overflowing from a first collector formed by first vertical upright 2. Elliptical O-ring 22 can advantageously be replaced by any single seal of suitable form enabling the mechanical link between the inside of vertical upright 2 and the outside to be tightly sealed in a single tightening operation of nut 18.

Likewise, second fixing lug 16 is secured on second vertical upright 3 by means of second nut 19 which is designed to be arranged inside a second aperture 23 arranged through a second wall 24 of second vertical upright 3. In the same way as the arrangements concerning first wall 21, said second wall 24 is preferably a bottom wall of said second vertical upright 3. Second nut 19 is equipped with an electrical resistance 25 designed to heat the heat transfer fluid housed inside the second collector formed by second vertical upright 3. A second, preferably double, O-ring of elliptical cross-section 26 is fitted between second fixing lug 16 and second nut 19 to prevent the heat transfer fluid from overflowing from the second collector. Elliptical O-ring 26 can advantageously be replaced by any seal of suitable form enabling the mechanical link between the inside of vertical upright 3 and the outside to be tightly sealed in a single tightening operation of nut 19.

Towel drying radiator 1 comprises a protective shell 27 protecting a bottom end 28 of electrical resistance 25, this protective shell 27 preferably being formed by two protective half-shells, front half-shell 29 and rear half-shell 30.

Figure 6:
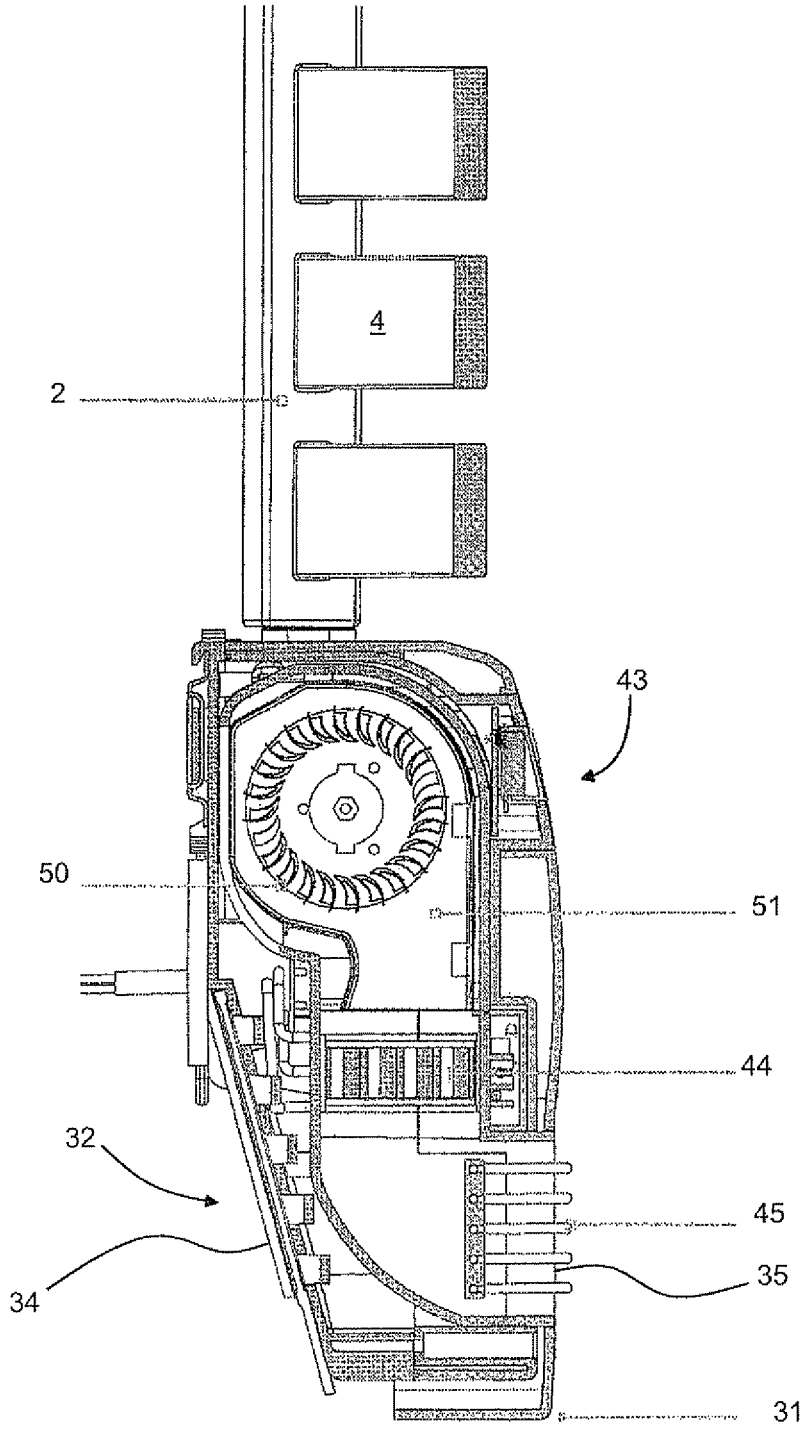
FIG. 6 is a partial longitudinal cross-sectional view of the towel drying radiator illustrated in FIG. 1.

Said device 7 comprises a case 31 provided with an air inlet 32 arranged through a first partition 33 of case 31, able to be seen in FIG. 6, first partition 33 being designed to be directed towards support surface 6 of towel drying radiator 1, such as a wall of a room of a home or suchlike. Air inlet 32 is provided with a particle filter 34 to prevent impurities from penetrating inside case 31. The latter 31 is also provided with an air outlet 35 arranged through a second partition 36 of case 31 which is placed facing first partition 33.

Case 31 is equipped with a decorative front panel 37 and with two decorative panels, respectively right 38 and left 39, that are able to bear patterns and/or inscriptions thereon.

Figure 4:
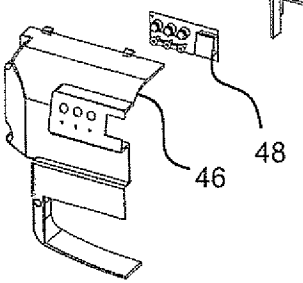
FIG. 4 is a schematic illustration of the case illustrated in FIG. 3 in cut-away cross-section and in exploded perspective view.
Figure 3:
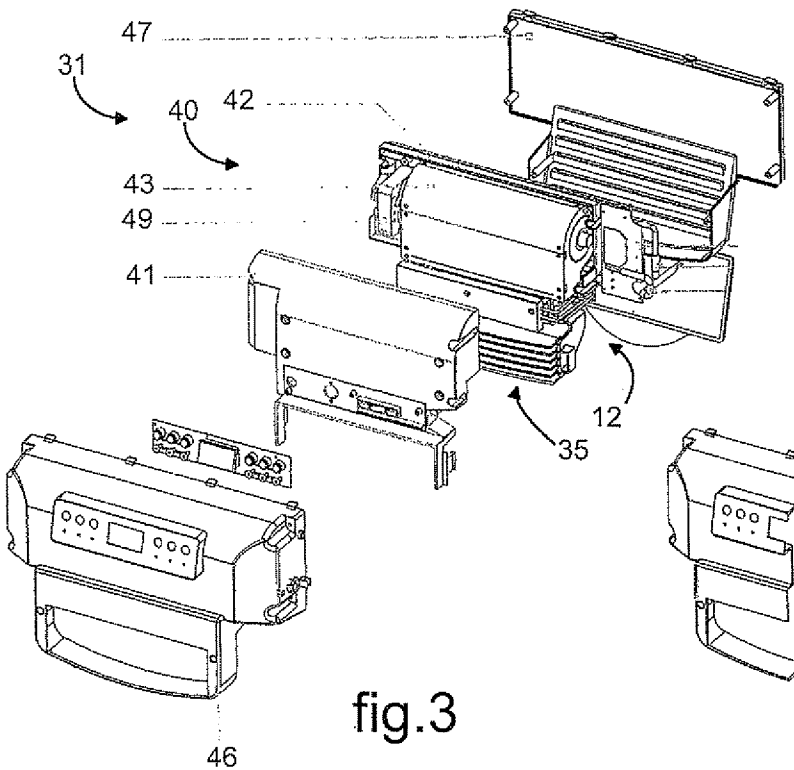
FIG. 3 is a schematic illustration in exploded perspective view of a participating case of the radiator illustrated in the previous figures.

In FIG. 3 and FIG. 4, case 31 houses a technical enclosure 40 formed by a front shell 41 and a rear shell 42 housing heating device 12. Heating device 12 comprises a pulser 43 to make an air flow circulate from air inlet 32 to air outlet 35 and a plurality of heating elements 44, of the resistance type with positive transfer coefficient or the like, to heat the air flow prior to the latter being delivered via air outlet 35. The latter 35 is equipped with fins 45 for directing the air flow, the orientation of the fins being able to be adjusted by the user to direct the air flow to a specific area.

Case 31 is formed by a front shell 46 and a rear shell 47 which are assembled to one another by clipping or the like. Front shell 46 is equipped with a control panel 48 for implementing operation of heating elements 44 and of an electric motor 49 which comprises pulser 43.

In FIG. 6, pulser 43 comprises a turbine 50 housed inside a volute casing 51, turbine 50 being designed to make the air flow circulate from air inlet 32 to air outlet 35.

Figures 7A, 7B, 7C, 7D:
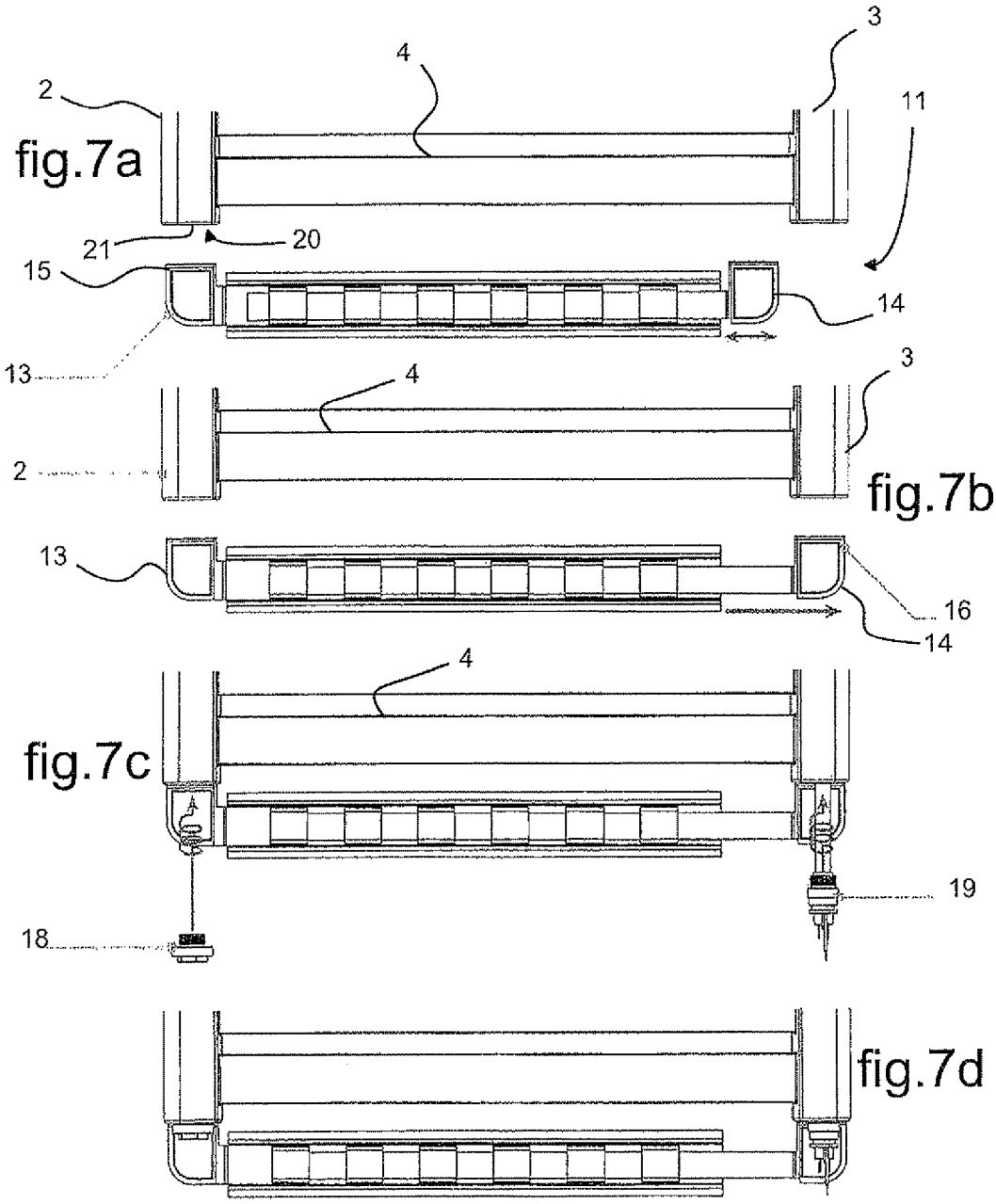
FIGS. 7*a* to 7*d* are schematic views of successive steps of a method for fixing a telescopic rail on vertical uprights which comprises the radiator illustrated in FIG. 1.

In FIG. 7*a* to FIG. 7*d*, a method for fixing telescopic rail 11 is described. In FIG. 7*a*, first fixing lug 15 which equips fixed rail 13 is placed facing first aperture 20 arranged though first bottom wall 21 of first vertical upright 2. In FIG. 7*b*, movable rail 14 is manipulated by sliding inside fixed rail 13 to position second fixing lug 16 facing second aperture 23 arranged through second bottom wall 24 of second vertical upright 3. In FIG. 7*c*, first nut 18 is screwed into first aperture 20 whereas second nut 19 is screwed into second aperture 23 until fixing lugs 15,16 are firmly secured against the respective vertical uprights 2,3.

Figures 8A, 8B:
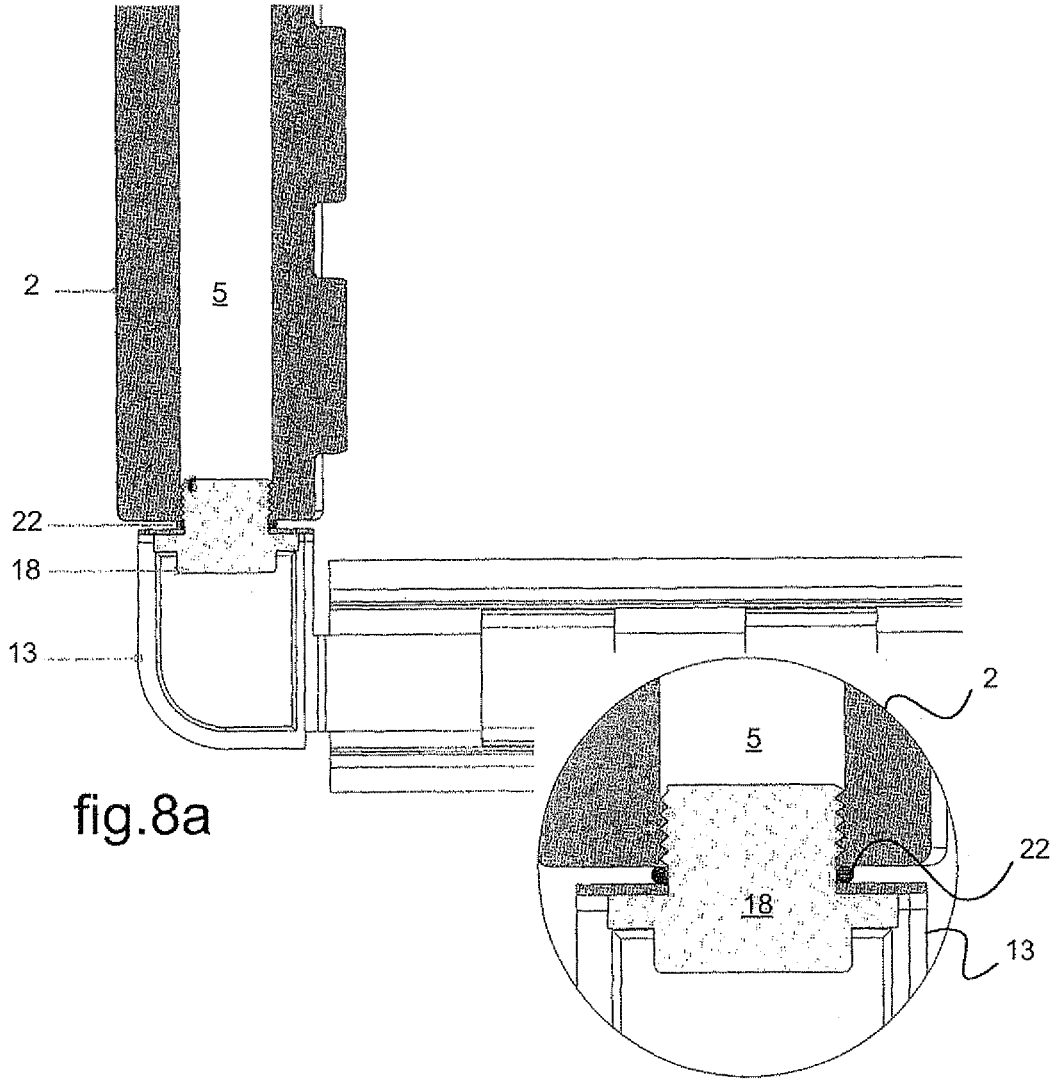
FIG. 8*a* is a partial schematic view of means for fixing the telescopic rail onto a first vertical upright of the radiator, FIG. 8*b* being a view of a detail of FIG. 8*a*.

In FIG. 8 and FIG. 8*b*, elliptical cross-section O-ring 22 is fitted between first fixing lug 15 and first vertical upright 2 to ensure tightness between the latter and to prevent the heat transfer fluid from overflowing from the circulation circuit of the latter.

Figures 9A, 9B:
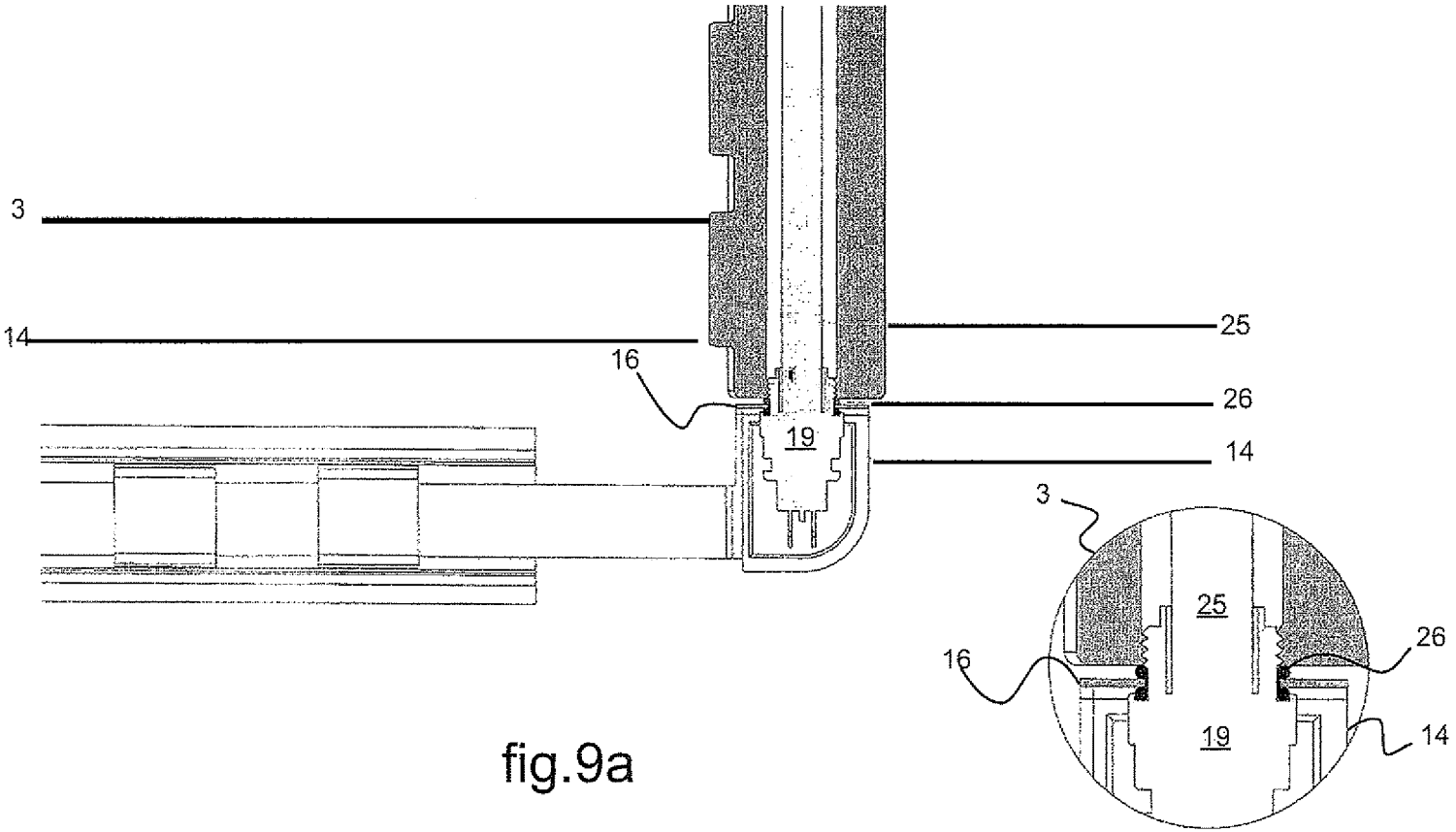
FIG. 9*a* is a partial schematic view of means for fixing the telescopic rail onto a second vertical upright of the radiator, FIG. 9*b* being a view of a detail of FIG. 9*a*.

Likewise, in FIG. 9*a* and FIG. 9*b*, double elliptical cross-section O-ring 26 is fitted between second fixing lug 16 and second vertical upright 3 on the one hand and second nut 19 on the other hand to ensure tightness between the latter and to prevent the heat transfer fluid from overflowing from circulation circuit 5 of the latter.

It is clear that the O-rings described above can be replaced by any other sealing system designed to prevent leakage of the heat transfer fluid.

Figures 10A, 10B:
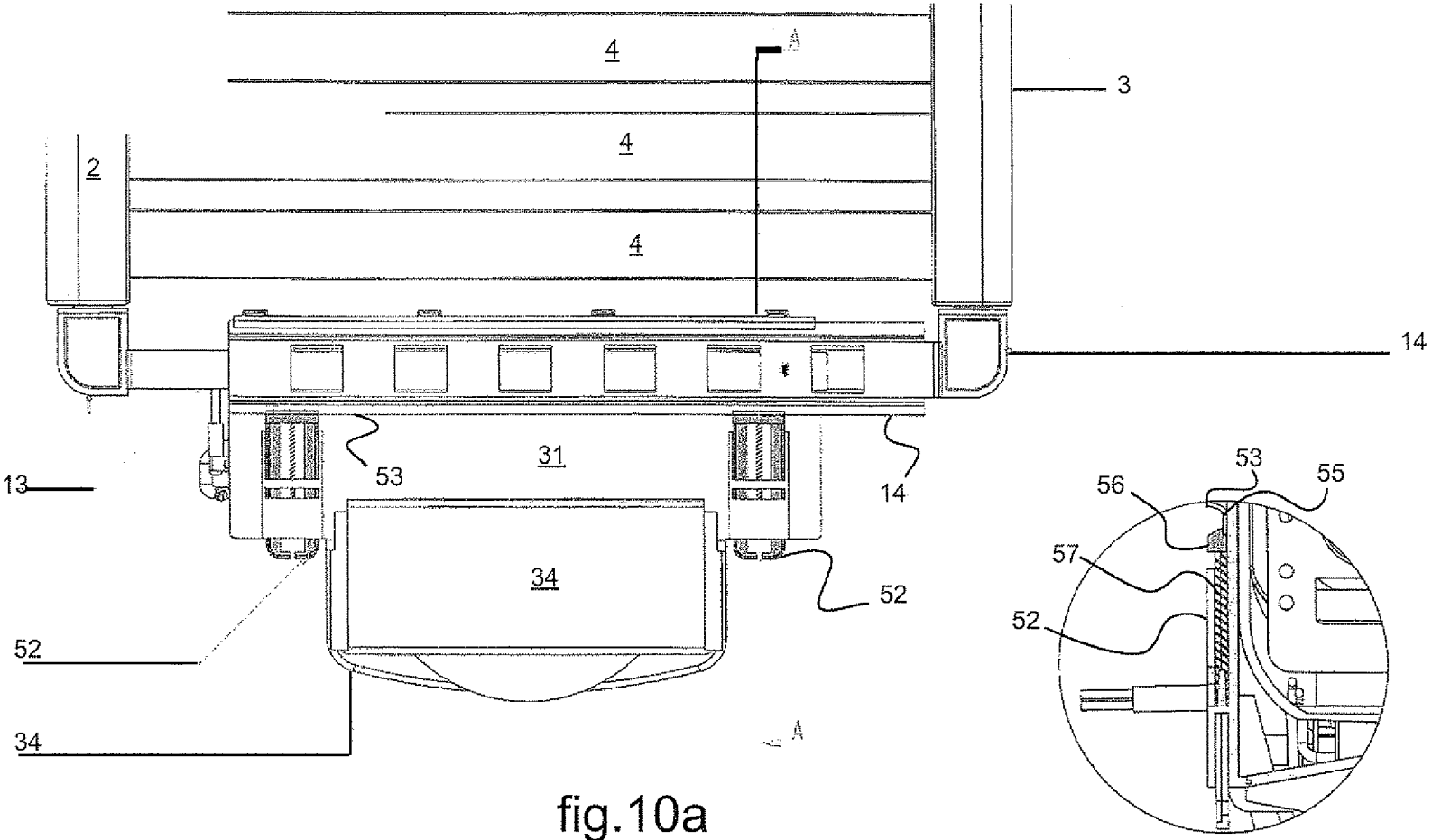
FIG. 10*a* is a partial rear schematic view of the case fixed to the telescopic rail.
FIG. 10*b* is a view of a detail of FIG. 10*a*.
Figures 11A, 11B, 11C, 11D, 11E, 11F, 11G, 11H:
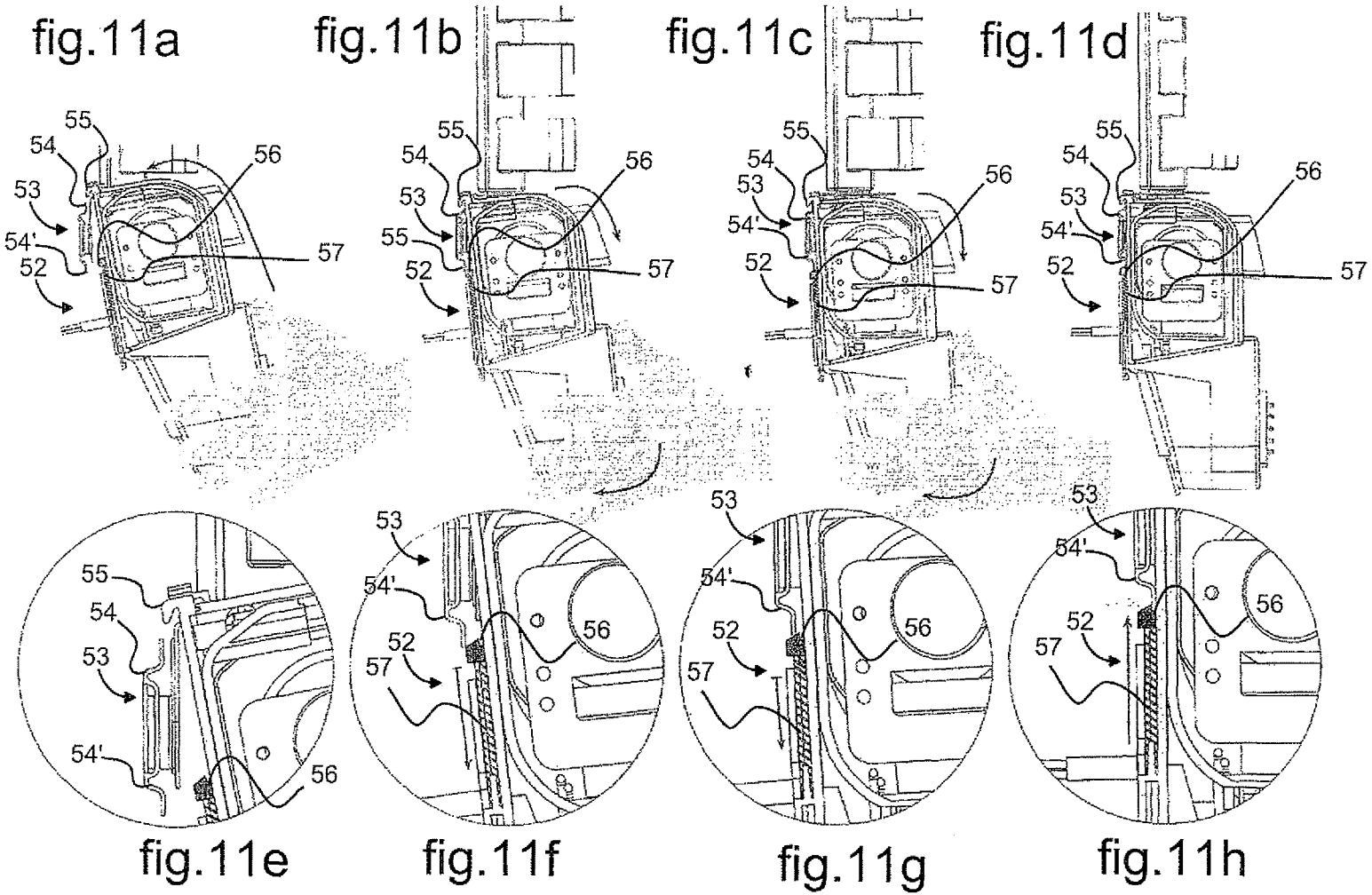
FIGS. 11*a* to 11*h* show the successive phases of assembly of the case on the rail.

In FIG. 10*a* and FIG. 10*b*, case 31 is equipped with two securing clips 52 for securing the latter in position on telescopic rail 11 and more particularly on a support rail 53 which telescopic rail 11 comprises. In FIG. 11*a* to FIG. 11*h*, support rail 53 comprises a top groove 54 receiving a hook-latch 55 arranged on case 31, and a bottom groove 54' receiving a head 56 borne by securing clip 52. Securing clip 52 comprises a spring 57 to facilitate engagement of head 56 of securing clip 52 in bottom groove 55 of support rail 53. It is completed by a mechanical safety device of cotter-pin type, which is inserted after clip 52 has been fitted on support rail 53 to prevent any subsequent translation of the clip part.

Figure 12A:
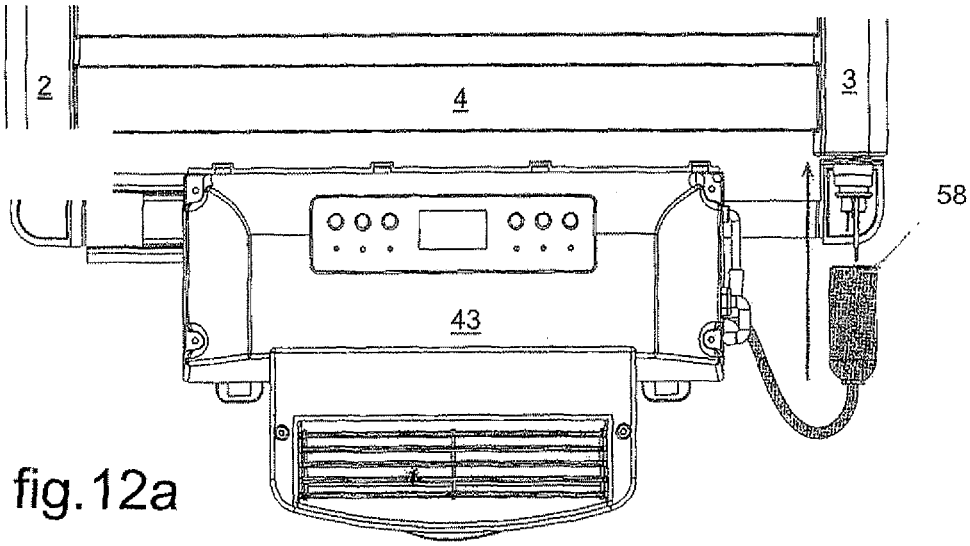
Figure 12B:
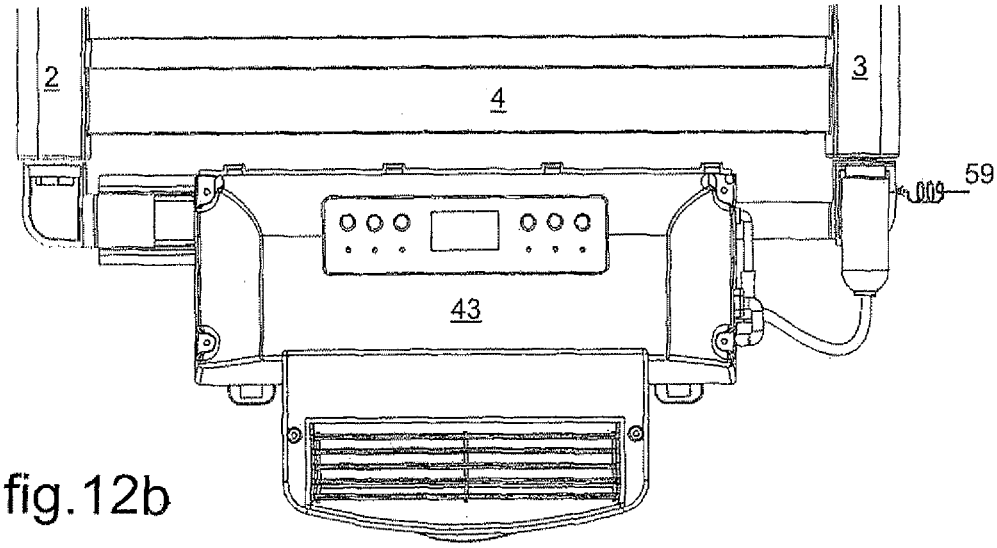
Figures 13A, 13B:
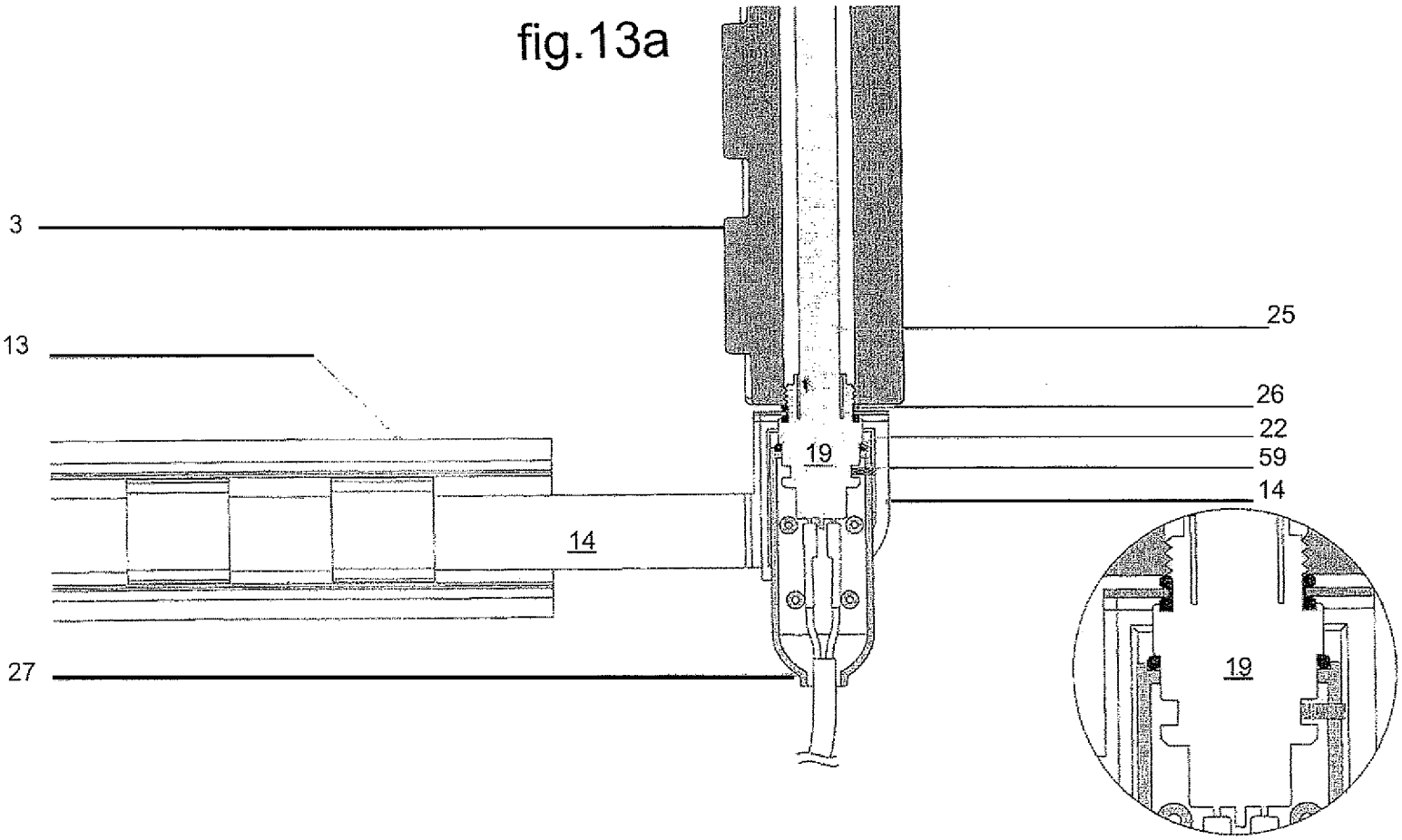

In FIG. 12*a* and FIG. 12*b*, a method for connecting pulser 43 to towel drying radiator 1 is described. Pulser 43 is equipped with an electrical connecting lead 58 for connection to second nut 19 to implement electrical resistance 25. Electrical connecting lead 58 is secured on second vertical upright 3 by means of a cone-point set screw 59, also able to be seen in FIG. 13*a* and FIG. 13*b*.

In FIG. 14, particle filter 34 is easily accessible from a front area 60 of said device 7 for maintenance and/or replacement purposes.

The invention claimed is:

1. A towel drying radiator with a heat transfer fluid comprising two vertical uprights between which heating bars are arranged, said radiator being equipped with an additional heating device for heating an air flow, wherein said device comprises a telescopic rail supporting a heating apparatus of an air flow, said telescopic rail being provided with fixing means for fixing to the two vertical uprights of said radiator, said fixing means constituting means for blanking off two apertures arranged through a respective wall of said vertical uprights.

2. The radiator according to claim 1, wherein said device is at least partially arranged inside a general extension plane P of the device comprising the vertical uprights and heating bars.

3. The radiator according to claim 1, wherein said device comprises a case provided with at least one air inlet arranged through a first partition of the case which is designed to be directed towards a support surface of said radiator, and with at least one air outlet arranged through a second partition of the case which is placed facing the first partition.

4. The radiator according to claim 3, wherein the case is equipped with at least one decorative panel provided with patterns.

5. The radiator according to claim 3, wherein the case houses a pulser and at least one heating element, and in that it supports a control panel for implementing the pulser and heating element.

6. The radiator according to claim 3, wherein the case and the telescopic rail are equipped with cooperating support means.

7. The radiator according to claim 6, wherein said support means are of the type by clipping with complementary safety securing.

8. The radiator according to claim 1, wherein said fixing means on the one hand comprise a first nut for fixing a first fixing lug equipping the telescopic rail on a first vertical upright, and on the other hand comprise a second nut for fixing a second fixing lug equipping the telescopic rail on a second vertical upright, the second fixing nut being integral to an electrical resistance housed inside the second vertical upright, the first nut and second nut being equipped with O-rings.

9. The radiator according to claim 1, wherein the air inlet is equipped with a removable particle filter.

10. The radiator according to claim 3, wherein the air outlet is equipped with at least one fin for directing a flow of hot air.

* * * * *